US006334497B2

(12) United States Patent
Odell

(10) Patent No.: US 6,334,497 B2
(45) **Date of Patent: *Jan. 1, 2002**

(54) WHEELCHAIR MOTORIZING APPARATUS

(76) Inventor: George V. Odell, 544 El Rio Rd., Danville, CA (US) 94526

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/156,958

(22) Filed: Sep. 18, 1998

(51) Int. Cl.[7] ..... A47A 1/02

(52) U.S. Cl. ..... 180/65.1; 180/11; 280/250.1; 280/304.1

(58) Field of Search ..... 180/907, 11, 15, 180/65.1, 60, 295, 908; 280/304.1, 250.1; 297/338, 339, 344.18, 344.12

(56) References Cited

U.S. PATENT DOCUMENTS

| | | | | | |
|---|---|---|---|---|---|
| 1,905,588 | A | * | 4/1933 | Harris | 297/344.18 |
| 2,522,180 | A | * | 9/1950 | Jones | 297/344.12 |
| 2,937,692 | A | * | 5/1960 | McMihael, Jr. | 297/344.18 |
| 3,770,073 | A | | 11/1973 | Meyer | |
| 3,807,795 | A | * | 4/1974 | Weant et al. | 297/339 |
| 3,845,835 | A | | 11/1974 | Petit | |
| 3,905,437 | A | | 9/1975 | Kaiho et al. | |
| 4,067,409 | A | * | 1/1978 | DiMatteo et al. | 180/6.5 |
| 4,387,781 | A | | 6/1983 | Ezell et al. | |
| 4,545,616 | A | * | 10/1985 | Booth | 297/344.12 |
| 4,907,303 | A | * | 3/1990 | Baird | 297/339 |
| 4,955,624 | A | * | 9/1990 | Jeun-Long | 280/304.1 |
| 5,112,076 | A | * | 5/1992 | Wilson | 280/304.1 |
| 5,161,630 | A | | 11/1992 | Garin, III et al. | |
| 5,197,559 | A | | 3/1993 | Garin, III et al. | |
| 5,211,414 | A | * | 5/1993 | Galumbeck | 280/250.1 |
| 5,351,774 | A | | 10/1994 | Okamoto | |
| 5,445,431 | A | * | 8/1995 | Johnston | 297/339 |
| 5,477,935 | A | | 12/1995 | Chen | |
| 5,816,655 | A | * | 10/1998 | Hoegh | 297/338 |
| 5,868,469 | A | * | 2/1999 | Ming | 297/338 |
| 5,951,105 | A | * | 9/1999 | Sletteb | 297/338 |

* cited by examiner

*Primary Examiner*—Lanna Mai
*Assistant Examiner*—Hau Phan
(74) *Attorney, Agent, or Firm*—Theodore J. Bielen, Jr.

(57) ABSTRACT

A wheelchair motorizing apparatus which is mounted to a wheelchair frame utilizing a guide. The guide is oriented in a generally upright configuration. A support is movable along the guide for positioning upwardly and downwardly relative to the existing wheels of a wheelchair. A driven wheel is connected to the support and engages the ground surface when the support is moved into the downward position.

6 Claims, 2 Drawing Sheets

WHEELCHAIR MOTORIZING APPARATUS

BACKGROUND OF THE INVENTION

The present invention relates to a novel and useful apparatus for motorizing a wheelchair.

Wheelchairs have been used for a long period of time to carry persons, who are disabled temporarily or permanently, from place to place. In many cases the person in the wheelchair is able to turn the side wheels of the wheel chair manually to move the wheelchair forward or backward. In certain cases, the person in the wheelchair must employ another person to push or pull the wheelchair as needed. Usually, in the later case that person requiring an attendant lacks the arm strength necessary to turn the wheels of the wheelchair. Also, manual wheelchairs are difficult to operate on inclined surfaces.

In the past, wheelchairs have been equipped with a motor to run the same by operation of a paddle switch or lever conveniently placed on an arm of the wheelchair. For example, U.S. Pat. Nos. 3,770,073, 5,161,630, 5,197,559, and 5,477,935 describe mechanical linkages which are connected to a motor to drive the axles of the wheels of wheelchairs.

U.S. Pat. Nos. 3,845,835 and 4,387,781 describe electric power plants which are used with vehicles such as wheelchairs to generate electrical power.

U.S. Pat. No. 5,351,774 describes a wheelchair having a detachable power unit which is connectable to the rear of the wheelchair by a locking mechanism.

U.S. Pat. No. 3,905,437 describes a wheelchair that has an electric driving unit connected to the wheelchair that pivotally swings down into place to allow the wheelchair to climb and descend steps and curbs.

An apparatus which is capable of motorizing a manually operated wheelchair would be a notable advance in the field of medical equipment.

SUMMARY OF THE INVENTION

In accordance with the present invention a novel and useful apparatus for motorizing a wheelchair is herein provided.

The apparatus of the present invention utilizes a guide and mounting means for attaching the guide to the wheelchair frame. The guide is oriented by the attachment means to include a vertical component, thus permitting the guide to travel upwardly and downwardly relative to the frame of the wheelchair. The mounting means may take the form of tracks that are connected to the rear frame members of the wheelchair.

Another element of the apparatus of the present invention externalizes in a support that is capable of engaging the guide and traveling along the same in an upward and downward direction. Positioning means is provided for urging such movement of the support along the guide and may take the form of a cable and lever. In certain cases, the support may be biased in a downward position by spring means or other known biasing components.

Motive means is also included for propelling the wheelchair. The motive means is secured, at least in part, to the support. For example, the motive means would include a wheel or track, a motor, a gearing mechanism, and the necessary control components to actuate the motor. Thus, when the positioning means urges the support downwardly, the wheel or track would contact the traveling surface for the wheelchair. Also, the reverse would be true in that movement of the support by the positioning means in an upward direction would disengage the wheel from the traveling surface and immobilize the wheelchair.

It may be apparent that a novel and useful apparatus for motorizing a wheelchair has been described.

It is therefore an object of the present invention to provide an apparatus for motorizing a wheelchair which is easily adapted to a conventional manual wheelchair.

A further object of the present invention is to provide an apparatus for motorizing a wheelchair which is simple and effortless to operate.

A further object of the present invention is to provide an apparatus for motorizing a wheelchair which is compact and does not interfere with the operation of the wheelchair in its manual condition.

Yet another object of the present invention is to provide an apparatus for motorizing a wheelchair which allows the user of the wheelchair to employ the normal steering system found in a manually operated wheelchair.

Another object of the present invention is to provide an apparatus for motorizing a wheelchair which is simple to install on a manual wheelchair without the need for special tools.

The invention possesses other objects and advantages especially as concerns particular characteristics and features thereof which will become apparent as the specification continues.

Figure 1:
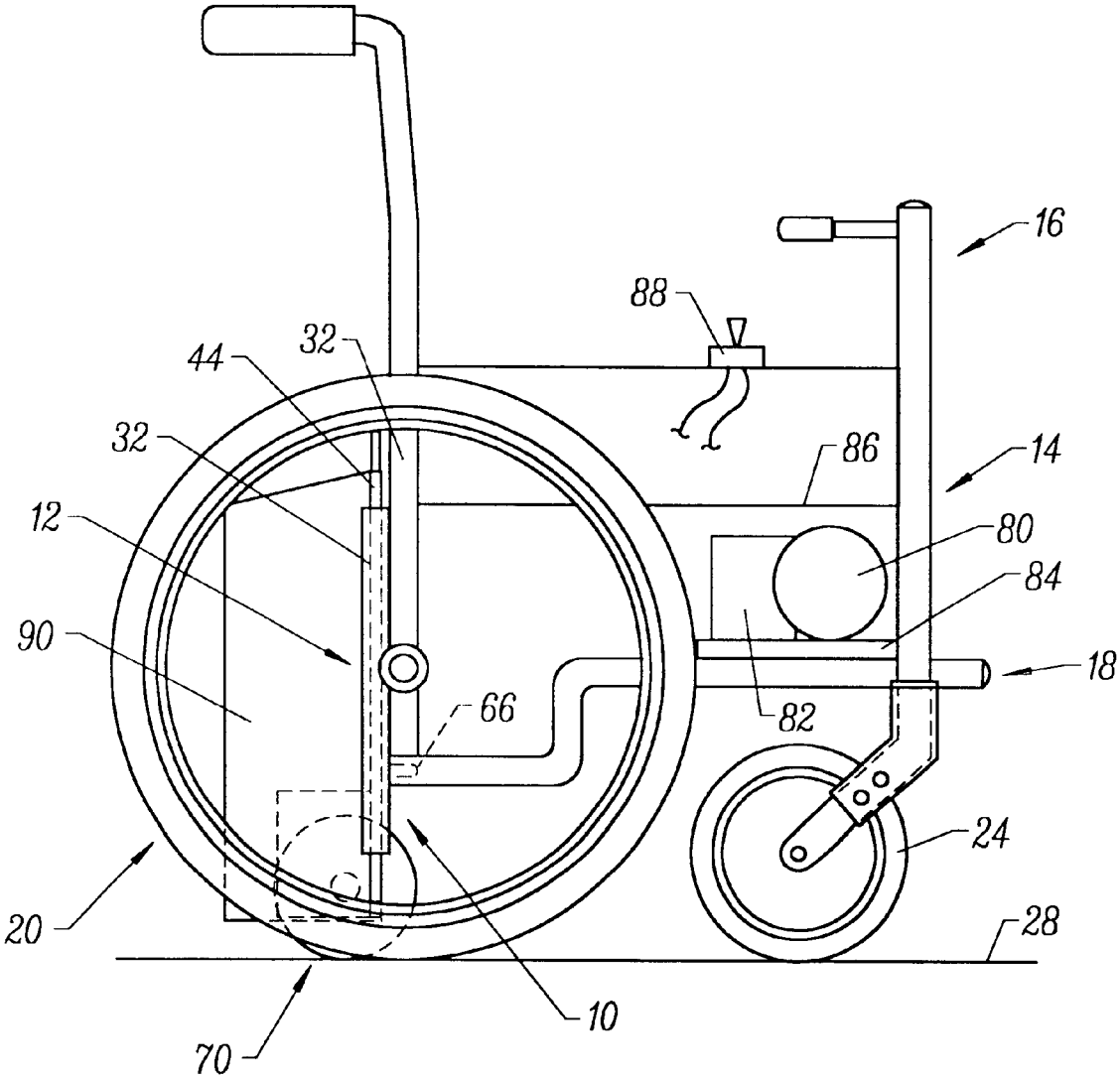
FIG. 1 is a side elevational view of a wheelchair with the apparatus of the present invention installed thereupon.

For a better understanding of the invention reference is made to the following detailed description of the preferred embodiments thereof which should be referenced to the above described drawings.

DETAILED DESCRIPTION OF THE PREFERRED EMBODIMENTS

Various aspects of the present invention will evolve from the following detailed description of the preferred embodiments which should be taken in conjunction with the prior described drawings.

The invention as a whole is depicted in the drawings by reference character 10. Apparatus 10 includes as one of its components a guide 12 which is fixed to wheelchair 14, a conventional manually operated wheelchair. It should be noted that wheelchair 14 includes a steering tiller 16, frame 18, and hand operable wheels 20 and 22. Tiller 16 is connected to one or more steering wheels such as steering wheel 24 depicted in FIG. 1.

Figure 2:
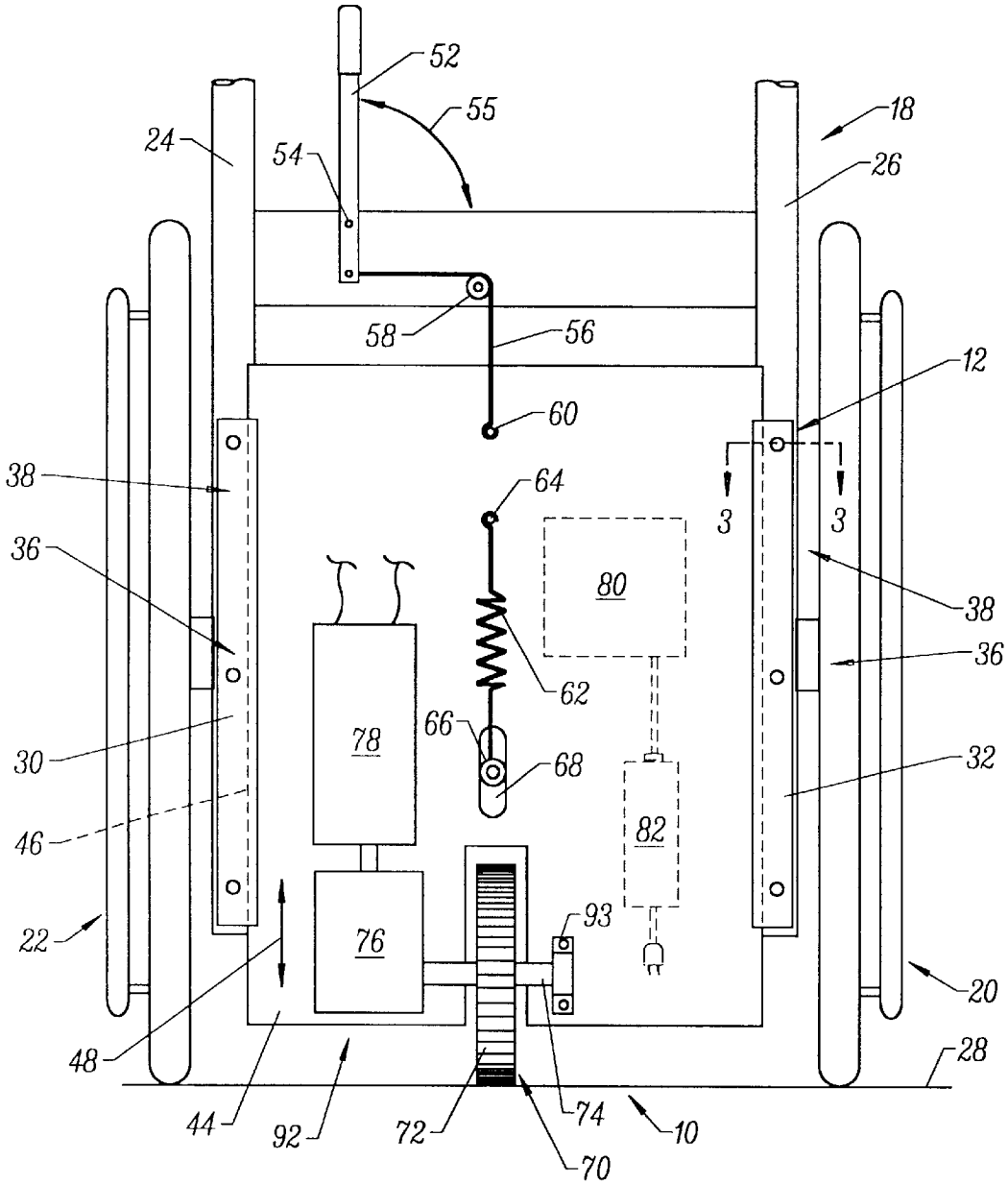
FIG. 2 is a rear elevational view of the wheelchair and apparatus of the present invention depicted in FIG. 1.
Figure 3:
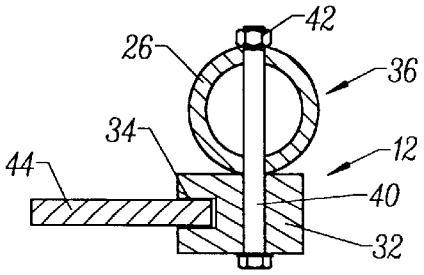
FIG. 3 is a sectional view taken along line 3—3 of FIG. 3.

Guide 12 is fixed to a portion of frame 18 toward the rear of wheelchair 14. Namely, stanchions 24 and 26 are employed in this regard. Stanchions 24 and 26 are oriented in a generally upright direction relative to traveling surface 28, FIG. 2. With reference to FIGS. 2 and 3, it may be observed that guide 12 includes a pair of rectangular solid members 30 and 32 each having a track or slot. With reference to FIG. 3, the detailed construction of rectangular solid member 32 is depicted. It should be understood that rectangular solid 30 possesses a similar construction and is the mirror image of rectangular solid member 32, in this regard. Track 34 extends the length of rectangular solid member 32. Mounting means 36 is employed to hold members 30 and 32 to stanchions 24 and 26, respectively. Mounting means 36 takes the form of a plurality of bolts 38 which pass through stanchions 24 and 26. With reference to FIG. 3, it may be seen that bolt 40 is depicted as extending through stanchion 26. Nut 42 holds bolt 40 in place in the conventional manner. Bolts 40 also compresses member 32 to stanchion 26 in this regard. Mounting means 36 is also employed in the same manner with respect to member 30 and stanchion 24. Members 30 and 32 fastened to stanchions 24 and 26 do not interfere with the operation of wheelchair 14.

Support 44 is also employed in the present invention. Support 44 takes the form of a plate which is capable of riding within track 34 of member 32 and the track 46 associated with member 30. Directional arrow 48 indicates the up and down movement of support 44. Positioning means 50 urges movement of support 44 along guide 12 in a vertical, "up and down", direction. Positioning means takes the form of a lever 52 which rotates around a pivot 54, FIG. 2. Directional arrow 55 indicates the rotational movement of lever arm 52. Cable 56 rides over a pulley 58 and is fastened to support 44 at bore 60. As shown in FIG. 2, support 44 is in a "down" position. The rotation of lever 52 clockwise will raise support 44 from traveling surface 28 into the "up" position. Spring 62 connected to support 44 at bore 64 and to a stationary pin 66, biases support 44 downwardly. Pin 66 is connected to a portion of frame 18 and rides in slot 68 through support 44.

Motive means 70 propels wheelchair 14. Motive means 70 includes a wheel 72 rotatably attached to support 44 via axle 74. Gear reducer 76 and electric motor 78 are also fixed or fastened to support ,46 with reference to FIGS. 1 and 2, it may be noted that a battery charger 80 and a battery and power cord retractor 82 are placed forward of support 44 on a platform 84 beneath wheelchair seat 86. A paddle switch 90 is schematically depicted on FIG. 1 to control the operation of motor 78 in the forward or reverse direction in a conventional manner. FIG. 1 also depicts a cover 90 which may be placed over the components found on support 44. Cover 90 may be of soft rigid or semi rigid material. Means 92 secures the various components to support 44 in the conventional manner such as the use of screws, bolts, adhesives, friction fitting, and the like. Bracket 93 of axle 74 represents such securing means 92.

In operation, wheelchair 14 is fitted with guide 12 by the use of mounting means 36. That is to say stanchions 24 and 26 are fitted with rectangular solid-shaped members 30 and 32 by the use of mounting means 36. Support 44 is then placed within the tracks, such as track 34 of member 32. Cable 56 is then attached to opening 60 through support 44 and passed over pulley 58 to the base of lever arm 52. Spring 62 is then attached to bore 64 and pin 66 which is itself fastened to frame 18. Motor 78, gear reducer 76, and wheel 72 are then attached to support 44 or attached to support 44 prior to fitting the same within guide 12. The electrical connections are then made between the motor 78 and paddle switch 88. Support 44 is then moved downwardly into the position shown in FIG. 2 for use. When not utilized, apparatus 10 would be deactivated by moving lever arm 52 in a clockwise direction lift support 44 and wheel 72 from traveling surface 28. Battery charger 80 may then be employed to reactivate battery 82 in order to use apparatus 10 at a future time.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An apparatus for motorizing a wheelchair for travel on a surface, comprising:

a. a guide, said guide comprising a pair of tracks, said pair of tracks being spaced from one another, each of said pair of tracks being fastened to the frame of the wheelchair;

b. mounting means for attaching said guide to the wheelchair, said guide oriented by said attachment means to the wheelchair to include a vertical component;

c. a support, said support engaging said guide;

d. positioning means for urging movement of said support along said guide and along said vertical component of said guide;

e. motive means for propelling the entire wheelchair for travel along the surface, and f. means for securing at least a portion of said motive means to said support, said positioning means urging movement of said support along said guide and along said vertical component of said guide to permit said portion of said motive means to contact the surface, said motive means propelling the entire wheelchair for travel along the surface upon contact of said motive means with the surface.

2. The apparatus of claim 1 in which said motive means includes a wheel, said wheel being secured to said support, said positioning means being capable of placing said wheel in at least a first position in contact with the surface and a second position above the surface.

3. The apparatus of claim 2 in which said motive means further includes a motor, said motor linked to said wheel.

4. The apparatus of claim 3 in which said means for securing at least a portion of said motive means to said support further includes means for securing said motor to said support.

5. The apparatus of claim 1 in which said positioning means comprises a line connected to said support and a lever connected to said line to move said support along said guide.

6. The apparatus of claim 5 in which said support is a plate.

* * * * *